United States Patent [19]

Kitchen et al.

[11] 4,060,862

[45] Dec. 6, 1977

[54] BOX SPRING ASSEMBLY HAVING SERPENTINE RIGHT ANGLE BEND SPRINGS THEREIN

[75] Inventors: John P. Kitchen, Georgetown; Neville L. Riddle, Lexington, both of Ky.

[73] Assignee: Hoover Ball and Bearing Company, Saline, Mich.

[21] Appl. No.: 681,132

[22] Filed: Apr. 28, 1976

[51] Int. Cl.[2] ..... A47C 23/04

[52] U.S. Cl. ..... 5/260; 5/255

[58] Field of Search ..... 5/255, 247, 246, 260, 5/351; 267/103, 107, 109, 110, 111, 112

[56] References Cited

U.S. PATENT DOCUMENTS

| | | | |
|---|---|---|---|
| 3,286,281 | 11/1966 | Slominski | 5/255 |
| 3,487,480 | 1/1970 | Slominski | 5/247 |
| 3,824,639 | 7/1974 | Mandusky | 5/260 |
| 3,827,090 | 8/1974 | Roe | 5/351 |

*Primary Examiner*—Casmir A. Nunberg

*Attorney, Agent, or Firm*—Olsen and Stephenson

[57] ABSTRACT

A box spring assembly consisting of a horizontally disposed rectangular frame and a plurality of main wire springs and intermediate wire springs connected to each other and mounted on the top side of the frame. Each of the springs has a generally straight wire body portion and depending end portions, each of which is of serpentine shape and has a pair of angularly related sections. The end portions are secured to the frame so that they are compressible in a vertical direction when subjected to downwardly directed load.

4 Claims, 4 Drawing Figures

FIG. 2
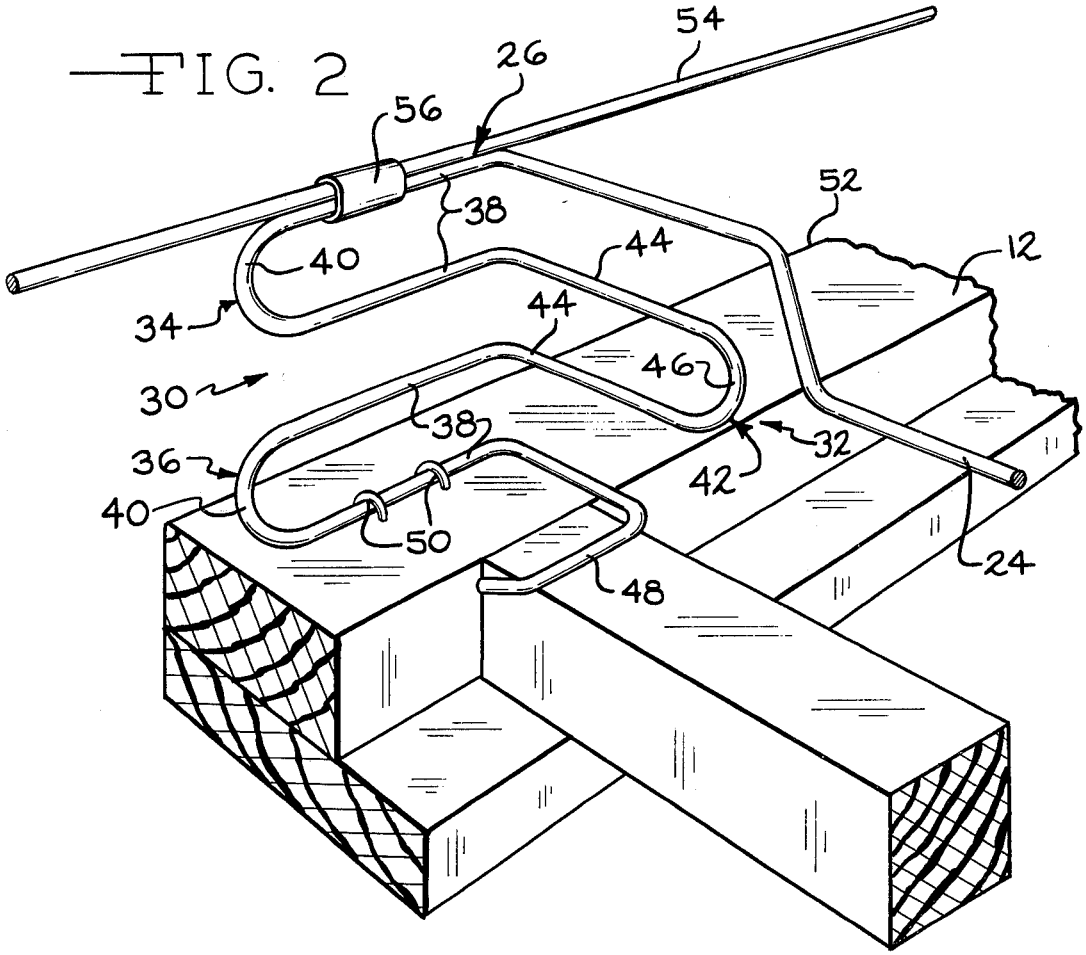
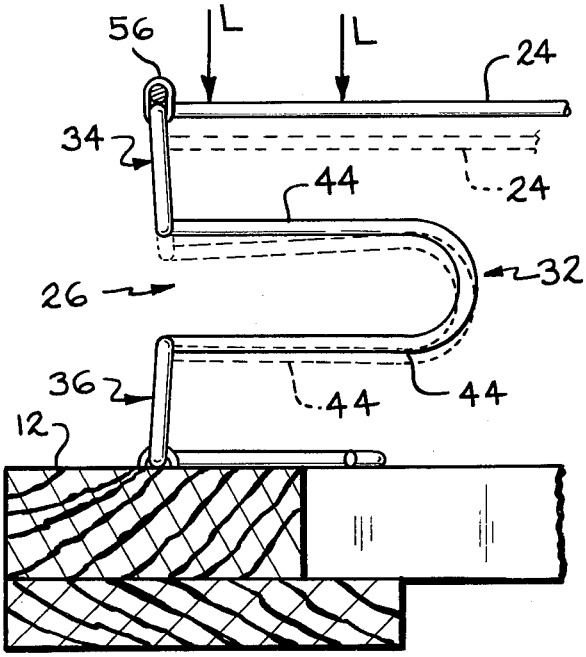
FIG. 3
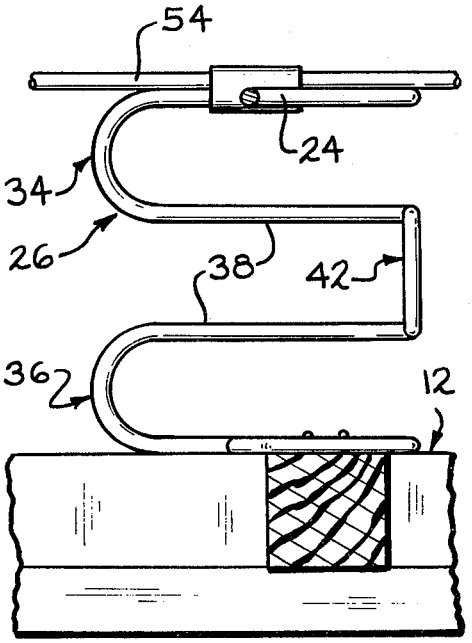
FIG. 4

BOX SPRING ASSEMBLY HAVING SERPENTINE RIGHT ANGLE BEND SPRINGS THEREIN

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; and 3,852,838. Box spring assemblies of the general type shown in the above list of patents, all of which are assigned to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly and cost of manufacture.

The present invention provides a box spring assembly which utilizes a different spring from the formed wire springs utilized in the patented box spring assemblies discussed above. The spring in the present box spring assembly is a stiffer spring than springs heretofore used, this increased stiffness being an inherent feature of the spring achieved by virtue of the spring configuration. Furthermore, this increased stiffness is achieved in a spring of reduced height relative to the springs heretofore used, thereby enabling the construction of the box spring assembly with even less wire than the wire required in the box spring assemblies shown in the above patents.

It is an object of this invention, therefore, to provide an improved box spring assembly having increased resistance to load and requiring a decreased amount of wire relative to prior art structures.

SUMMARY OF THE INVENTION

The box spring assembly which constitutes the present invention consists of a horizontally disposed rectangular frame and a plurality of special springs mounted on the top side of the frame and connected to each other so that the springs will interact in resisting downwardly directed bedding loads. The springs in the assembly consist of a plurality of main wire springs which extend longitudinally of the frame, a plurality of main wire springs which extend transversely of the frame and a plurality of intermediate springs which are connected to and extend between adjacent ones of the main wire springs. Each of the springs has a generally straight, in contrast to a sinuous or formed shape, main body portion and depending end portions, each of which is a serpentine shape and has a pair of angularly related sections, one of each pair of angularly related sections extending underneath the body portion and the other section projecting outwardly from the body portion at an angle. The main springs are arranged on the frame so that the angularly extending end sections are adjacent to the periphery of the frame and are secured to the top side of the frame. A conventional rectangular border wire is secured to and extends between the end portions of the main springs at a position overlying the frame and adjacent the periphery of the frame.

The resulting box spring assembly is provided with increased stiffness and thus increased resistance to bedding loads by virtue of the serpentine shapes of the spring end portions. This particular shaped spring end portion resists compression and does not require the torsion bars that are found in sinuous and formed wire springs in order to accommodate and absorb bedding loads. Accordingly, the spring end portions can be much shorter than the spring end portions in formed wire box spring assemblies, thereby effecting desired economies in the box spring assembly.

The increased stiffness of the assembly is particularly desirable from a bedding comfort standpoint since the comfort qualities of "hard" box spring assemblies are becoming more and more appreciated in the bedding field.

Further objects, features and advantages of this invention will become apparent from a consideration of the following description, the appended claims, and the accompanying drawing in which:

FIG. 2 is a fragmentary perspective view of a portion of the box spring assembly shown in FIG. 1;

FIG. 3 is a fragmentary transverse sectional view of a portion of the box spring assembly of this invention as seen from substantially the line 3—3 in FIG. 1; and FIG. 4 is a sectional view of the portion of the box spring assembly of this invention as seen from substantially the line 4—4 in FIG. 1.

Figure 1:
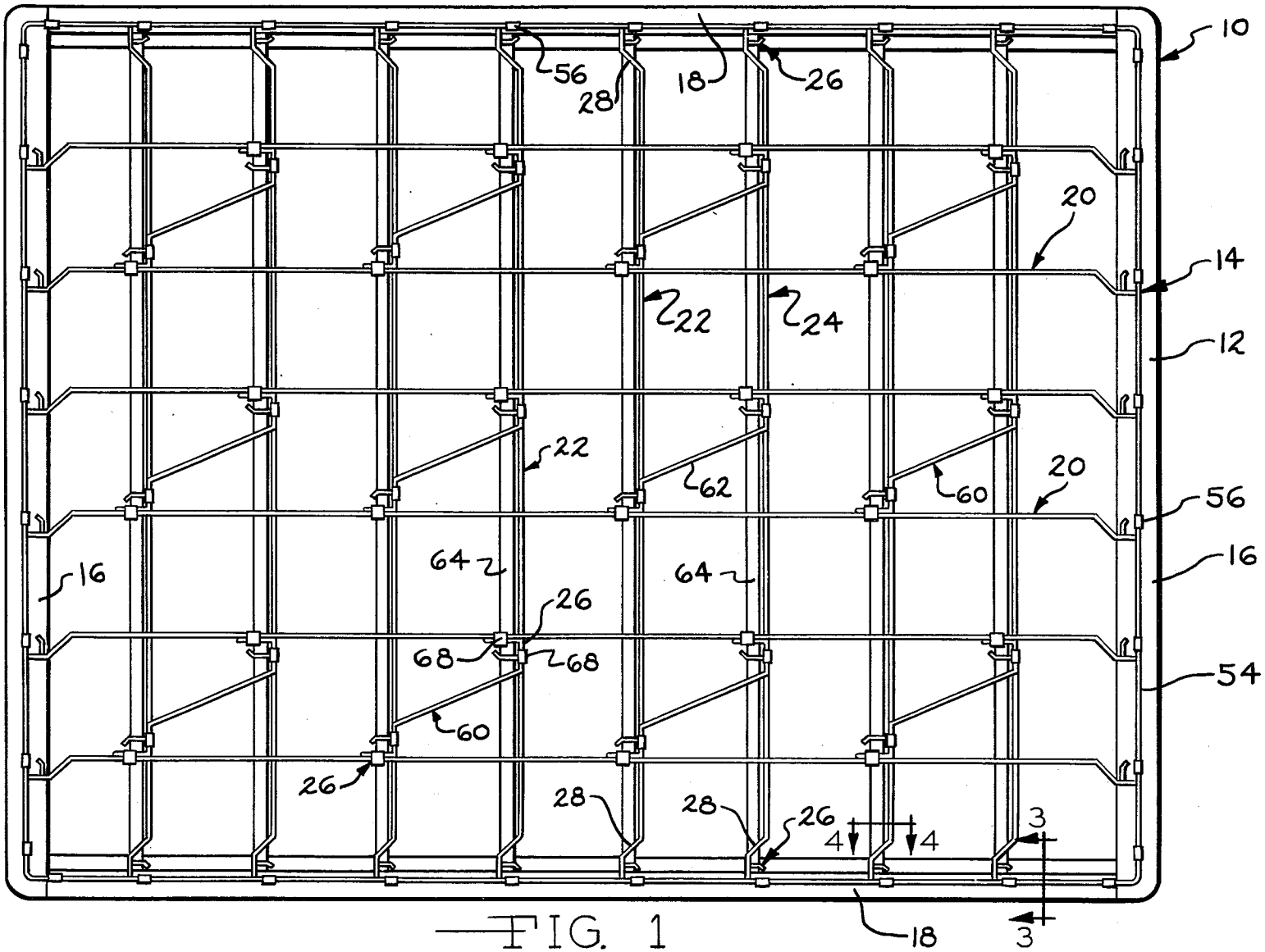
FIG. 1 is a plan view of the box spring assembly of this invention.

With reference to the drawing, the box spring assembly of this invention, indicated generally at 10, is illustrated in FIG. 1 as consisting of a generally rectangular horizontally disposed frame 12, usually formed of wood, and a wire spring assemblage 14 mounted on the top side of the frame 12. The frame 12 has a pair of parallel end rails 16 and a pair of side rails 18 which are parallel to each other and are longer than the end rails 16. The assemblage 14 consists of a plurality of first main springs 20 which extend longitudinally of the frame 12 and a plurality of second main springs 22 which extend transversely of the main frame 12. The main springs 20 and 22 are identical in all respects except for their lengths. Accordingly, only a spring 22 will be described in detail, with like numerals indicating like parts in the springs 20 and 22.

Each spring 22 has a body portion 24 and depending end portions 26, which are identical and only one of which is shown in FIG. 2. The body portion 24 consists of a generally straight length of wire integrally formed at its ends with the end portions 26. It is recognized that the ends 28 of the body portion 24 are offset relative to the center so that the body portion 24 is not perfectly straight. However, as used herein, the term generally straight is used to distinguish the shape of the body portion 24 from a sinuous or formed wire shape.

As shown in FIG. 2, each spring end portion 26 is of serpentine shape having a pair of sections 30 and 32 which are arranged at right angles with respect to each other. The section 30 consists of a pair of vertically spaced U-shape segments 34 and 36, which are substantially vertically aligned and each of which includes a pair of straight legs 38 secured to and formed integral with a connector 40 which is return bent upon itself. Similarly, the section 32 has a single U-shape segment 42 which has vertically spaced legs 44 disposed in a single vertical plane and a return bent upon itself connector 46 which is integral with and extends between the legs 44. The legs 44 constitute integral extensions of the lower leg 38 in the segment 34 and the upper leg 38 in the segment 36. A generally horizontal L-shape foot 48 is formed integral with the bottom leg 38 in the segment 36 and is engaged with the top side of the frame 12. Conventional staples 50 secure the bottom leg 38 to the frame 12. The segments 34 and 36 are inclined slightly inwardly toward each other to facilitate access of a stapling gun (not shown) to the lower leg 38 to apply the staples 50.

As shown in FIGS. 1 and 2, the section 30 of the spring end portion 26 is located adjacent to and parallel with the periphery 52 of the frame 12. The section 32 is perpendicular to the section 30 and underlies the spring body portion 24. A rectangular border wire 54, spaced a predetermined distance above the frame 12 and conforming in general to the rectangular shape of the frame 12, is secured to the springs 20 and 22 by means of conventional wrap-around-type spring clips 56. The border wire 54 is positioned on top of or along side the upper legs 38 in the main spring end portions 26 and is then secured thereto by means of the wrap-around clips 56, as illustrated in FIG. 2.

The spring assemblage also includes, in addition to the main springs 20 and 22 and the border wire 54, a plurality of intermediate springs 60 which function to connect adjacent ones of the main springs 20 and 22, which, as best appears in FIG. 1, are arranged in a criss-cross arrangement above the frame 12. Each intermediate spring 60 consists of a generally straight body portion 62 which extends diagonally between and is formed integral with spring end portions 26 identical to the end portions 26 previously described. The intermediate spring end portions 26 are supported on cross rails 64 which form part of the frame 12 and are secured thereto by conventional staples 66. Conventional clips 68, like the slips 56 previously described, are utilized to secure the springs 60 to the intersecting body portions 24 of the main springs 20 and 22. The intermediate springs 60 thus function to support and impart stiffness to the body portions 24 of the main springs 20 and 22 between the ends thereof.

In the use of the box spring assembly 10, the box spring frame 12 is supported on a suitable floor supported bed frame and the usual mattress is then supported on the top side of the spring assemblage 14, which is covered with the usual trim covering (not shown). The loads applied to the box spring assembly 10 by the mattress occupant will be downwardly directed loads such as indicated by the arrows L in FIG. 3. The loads L act to move the spring body portions 24 downwardly toward the frame 12. Such movement is resisted by the inherent resistance of the spring end portions 26 to compression. However, limited compression of each end portion 26 is achieved by movement of the legs 38 and 44 in the spring segments 34, 36 and 42 toward each other and the ability of each connector 40 and 46 to deform slightly. However, the natural resistance of the end portions 26 to such deformation, indicated in broken lines in FIG. 3, imparts a substantial extent of stiffness to the spring end portions 26. The result is a spring assemblage 14 which is compressible in a vertical direction as shown in broken lines in FIG. 3 when subjected to the downwardly directed load L and is extensible upwardly in response to removal of the load L.

It should be noted that the end portions 26 resistance to load is principally due to bending stresses in the portions 26. However, by virtue of the disposition of the segment 32 at substantially a right angle to the segments 34 and 36, the segment 32 also has torsional stresses induced therein. Thus, the configuration of the main springs so that portion of the springs resist load in both bending and torsion enables provision of stronger springs with less wire.

From the above description, it is seen that this invention provides an improved box spring assembly 10 which will impart a desired increase in firmness to a bedding mattress. This is accomplished with less spring wire than has previously been used in commercial box spring structures, and the springs 20, 22 and 60, which are the major components of the assembly 10, are capable of being fabricated on wire bending machines. The frame 12 can be structured in a variety of ways to accomplish the desired height in the overall box spring assembly 10 so as to compensate for the reduced height of the spring end portions 26 relative to the springs in conventional box spring assemblies.

What is claimed:

1. In a box spring assembly which includes a generally rectangular frame, a plurality of main wire springs arranged on said frame so that some of said springs are perpendicular relative to each other and others are parallel to each other, each of said springs having an elongated body portion which is a substantially straight length of wire arranged above said frame and downwardly extending end portions, each of which is of serpentine shape and has a pair of angularly related sections, one of each pair underlying and being positioned generally in the plane of an end section of said body portion and another one of each pair extending generally perpendicular to said body portion, said end sections being secured to said frame adjacent the periphery thereof and being capable of flexing movement toward said frame when loaded and away from said frame when unloaded, said one section of said end portion being in a substantially vertical plane and having generally horizontal parallel legs and a return bent-upon-itself connector extending therebetween, said legs being subjected to both bending and twisting stresses during said flexing movement.

2. The structure according to claim 1 further including intermediate springs connected to and extending between adjacent parallel and perpendicularly arranged main springs in said assembly, each of said intermediate springs having end portions shaped like the end portions in said main springs.

3. A box spring assembly comprising a horizontally disposed rectangular frame, a plurality of main wire springs extending longitudinally of and mounted on the top side of said frame, a plurality of main wire springs extending transversely of and mounted on the top of said frame, each of said main springs having an elongated body portion which is a substantially straight length of wire arranged above said frame and downwardly extending end portions each of which is of serpentine shape and has a pair of angularly related sections, one of said angularly related sections being perpendicular to the other one of said angularly related sections and extending generally perpendicular to said body portion, said main springs being arranged on said frame so that said perpendicularly extending end sections are adjacent to the periphery of said frame, the other one of said angularly related sections being positioned below and in generally vertical alignment with said body portion, said other one of said sections being in a substantially vertical plane and having generally parallel legs and a return bent-upon-itself connector extending therebetween, said legs being subjected to both bending and twisting stresses during flexing movement of said spring end portion toward said frame when said spring is loaded, each of said perpendicularly extending sections terminating in a foot extending inwardly of and engaged with said frame, and means securing said perpendicularly extending sections to said frame, and rectangular border wire means secured to and extending between the end portions of said main springs at a position overlying said frame and adjacent the periphery thereof.

4. A box spring assembly according to claim 3 further including intermediate springs connected to and extending between adjacent ones of said main spring body portions, each of said intermediate springs having end portions shaped like the end portions in said main springs.

* * * * *